US007874528B2

(12) United States Patent
Keller

(10) Patent No.: US 7,874,528 B2
(45) Date of Patent: Jan. 25, 2011

(54) LIFT AND HOLD, ANTI-TIPPING TRASH CONTAINER SUPPORT SYSTEM

(76) Inventor: Charles Steve Keller, 1540 Union Hill Rd., Ennis, TX (US) 75119

( * ) Notice: Subject to any disclaimer, the term of this patent is extended or adjusted under 35 U.S.C. 154(b) by 352 days.

(21) Appl. No.: 12/164,092

(22) Filed: Jun. 29, 2008

(65) Prior Publication Data

US 2009/0321590 A1 Dec. 31, 2009

(51) Int. Cl.
*A63B 55/04* (2006.01)

(52) U.S. Cl. ..... 248/97; 248/907; 248/156; 220/908

(58) Field of Classification Search ..... 220/484, 220/908, 475; 211/85.19, 208; 248/500, 248/507, 97, 99, 100, 101, 907, 156
See application file for complete search history.

(56) References Cited

U.S. PATENT DOCUMENTS 783,099 A * 2/1905 Bryant ..... 248/507
2,505,885 A * 5/1950 Davis, Jr ..... 248/508
2,614,700 A * 10/1952 Kjeldsen ..... 211/75
2,891,753 A * 6/1959 Bittle ..... 248/149
3,527,355 A * 9/1970 Boyer ..... 211/85.19
3,822,845 A * 7/1974 Kennedy et al. ..... 248/147
4,940,201 A * 7/1990 Kurth ..... 248/101
5,090,753 A * 2/1992 Goodman ..... 292/230
5,735,494 A * 4/1998 Kurk ..... 248/97
6,439,517 B1 * 8/2002 Applegate ..... 248/154

FOREIGN PATENT DOCUMENTS

DE 3233743 A1 * 3/1984

* cited by examiner

*Primary Examiner*—A. Joseph Wujciak, III
(74) *Attorney, Agent, or Firm*—Rafaty Law Group, PLLC; Vesna N. Rafaty

(57) ABSTRACT

An anti-tipping container support system for supporting a container above a ground surface, the container comprising a substantially horizontal bar running across an outer wall of the container, the system comprising a support portion fixedly attached to the ground surface in a substantially perpendicular relationship to the ground surface, a lifting portion comprising a lever rotatably coupled to the support portion in substantially a T-orientation relative to the support portion, the lever comprising a handle and at least two connecting claws pivotally attached to the lever on opposite sides of the handle and substantially perpendicular to the lever, each connecting claw comprising a groove, such that when a manual downward force is applied to the handle with the bar of the container engaged in the grooves of the connecting claws, the container is lifted and supported off the ground surface.

6 Claims, 4 Drawing Sheets

LIFT AND HOLD, ANTI-TIPPING TRASH CONTAINER SUPPORT SYSTEM

BACKGROUND

The problem of outdoor trash containers tipping over in windy conditions or when animals rummage through them looking for food is known. Known prior art addressing the problem provides for innovations directed to secure locking of trash container lids. See for example U.S. Pat. Nos. 6,722,711 and 6,997,487 to Kitzis directed to a locking arrangement for a container with a cover. U.S. Pat. No. 4,666,054 to Jaicks discloses an animal-proof storage container system comprising a gripping means and hold-down means.

The applicant has invented a simple to use, relatively inexpensive to construct, both portable and fixed in-ground, self-contained, solution for the problem of tipping trash containers that is independent of the container lid design and does not require a separate support structure. The disclosed device is used to lift and hold a trash container or similar container in a secure, upright, off-ground position. So, for example when the container is a conventional outdoor trash container, when the container is engaged and supported above-ground in the disclosed support system, if an animal were to enter the container, for example by climbing along the wall of the container, removing the lid of the container (if the container is lidded), the container would remain securely in position off the ground, tipping-proof.

The term 'container' as used herein contemplates today's standard municipal government-provided trash containers which have a substantially planar rear wall surface with a handle bar attached running substantially across the width of the outer rear wall of the container near the top of the container. Additionally, the term 'container' as used herein also broadly encompasses other containers which are suitable for use with the disclosed container support system and which have a horizontal bar running across the width of at least one outer wall (side) of the container.

SUMMARY OF THE INVENTION

The applicant has invented a simple to use, relatively inexpensive to manufacture device for manual in-place lifting and secure storage of a container above a ground surface or other horizontal surface. The disclosed system has advantages over prior art because it is very simple to use and is ready for use without adjustments or use of clamps, ties, straps, has portability, is compatible with current outdoor trash containers and containers of varying sizes, is independent of container lid design, if the container is lidded at all. The container is available for normal use even while it is engaged in the disclosed device because per the preferred embodiment the container is lifted only a few inches off the ground.

The disclosed support system comprises a so-called first support element which essentially serves as the anchor or support for the whole system with the container. The first support may be permanently attached to the ground per the fixed embodiment of the disclosed system or it may be attached to a weighted base fitted with rollers as per a portable embodiment of the disclosed container support system. A second support element is coupled to the first support element in a substantially collinear relationship and has height adjustability features to accommodate containers of varying sizes and to allow support of the container at different vertical distances relative the ground or horizontal surface. The disclosed system also comprises a so-called working or lifting element of the system which is a rotatable arm lever coupled to the second support element in essentially a T-orientation creating a simple leveraged loading mechanism. Per the preferred embodiment, the arm lever is inserted inside a collar portion of the second support to create a T-lever with the second support. The arm lever of the lifting element has a handle and two connecting claws configured with smooth open grooves. The claws are fixedly and pivotally attached to the arm lever on opposite sides of the handle. The connecting claws are designed to engage the bar of the container which nests inside the grooves of the claws and with a downward manual force applied to the handle of the working portion, the claws rotate and the container is lifted off the ground with the claws engaging the bar of the container. The container can be disengaged from the device with application of a manual upward force on the handle portion of the arm lever. The term 'claw' as used herein is intended broadly to describe an element comprising a smooth open groove or curvilinear portion for nestably supporting a (handle) bar of the container where the (handle) bar may be readily disengaged from the claw with a direct or indirect force applied to the claw. Per the preferred embodiment of the disclosed system, the claws may be pivotally and fixedly attached to the arm lever at different positions along the arm lever to accommodate containers with varying widths. Thus, per the preferred embodiment, the arm lever is fashioned with diametrically spaced holes near each end of the arm lever. The hole of each connecting claw fits over holes of the arm lever and the claw is held in place via a pin and retaining clip. The claws are also adjusted to the necessary tilt angle as required for the container. Other means of adjustable attachment of the claws are known and are considered to be within the scope of this invention. While the preferred embodiment comprises two connecting claws, it is noted that alternative embodiments with more than two connecting claws are possible and are considered to be within the scope of the applicant's invention.

The disclosed device is compatible for use with city automatic trash pick-up services because the device with the trash container engaged therein presents the trash container in the right, unobstructed orientation for curbside automatic pick up and emptying by city garbage tricks. After emptying of the trash container, the city trick driver can deposit the container on the ground beside the disclosed device. Later, the container may be manually engaged in the disclosed device for safe, secure, tip-proof storage above the ground surface.

To engage the container in the disclosed device, the user first positions the trash container such that the wall of the container that has the horizontal bar faces the device and is in relatively close proximity to the claws of the device. Next, the user manipulates the handle of the lifting mechanism to next the bar of the container in the grooves of the claws. Then, with a manual downward force applied to the handle of the arm lever of the lifting mechanism, the container is lifted and 'locked' in place and is thus stably supported off the ground. The user then releases his/her hold of the handle which remains in a locked, down position and in a substantially parallel orientation with the wall of the container. To disengage the container from the disclosed device, the user takes the handle of the arm lever and applies a manual upward force on it thereby causing the claws to release contact with the bar of the container.

Per the preferred embodiment of the disclosed device, the first support comprises a height-adjustability feature to accommodate containers of varying sizes. Thus, according to the preferred embodiment, the first support has support element fashioned with a plurality of spaced holes. The support elements may be securely coupled at variable heights above the ground via alignment of the respective holes on the body of each support element and locking together with a connecting pin and retaining clip. It is noted that other known means for achieving the height adjustability feature are possible and are deemed to be within the scope of the applicant's invention.

According to a fully portable embodiment of the disclosed container support system, the first support is fixedly attached in a perpendicular orientation with a weighted base wherein the base is weighted to be able to support the lifting mechanism coupled to the first support as well as the container to be supported by the device. The portable embodiment may be rolled away with the container engaged therein by grabbing hold of the (handle) bar of the container and tilting back on the weighted base with rollers. The portable embodiment of the disclosed system is suitable for use in high traffic areas in homes as well as commercial settings where trash containers are susceptible to being tipped over accidentally and/or where it is desirable to have access to the floor underneath the container for cleanability.

It is further noted that the non-portable embodiment of the disclosed system where the first support element is permanently attached to the ground allows for portability of the second support element and the for theft avoidance.

The disclosed device can be manufactured using suitable metal or sturdy plastic such as PVC depending upon the anticipated weight of the container and its contents.

DETAILED DESCRIPTION OF THE DRAWINGS

Figure 2:
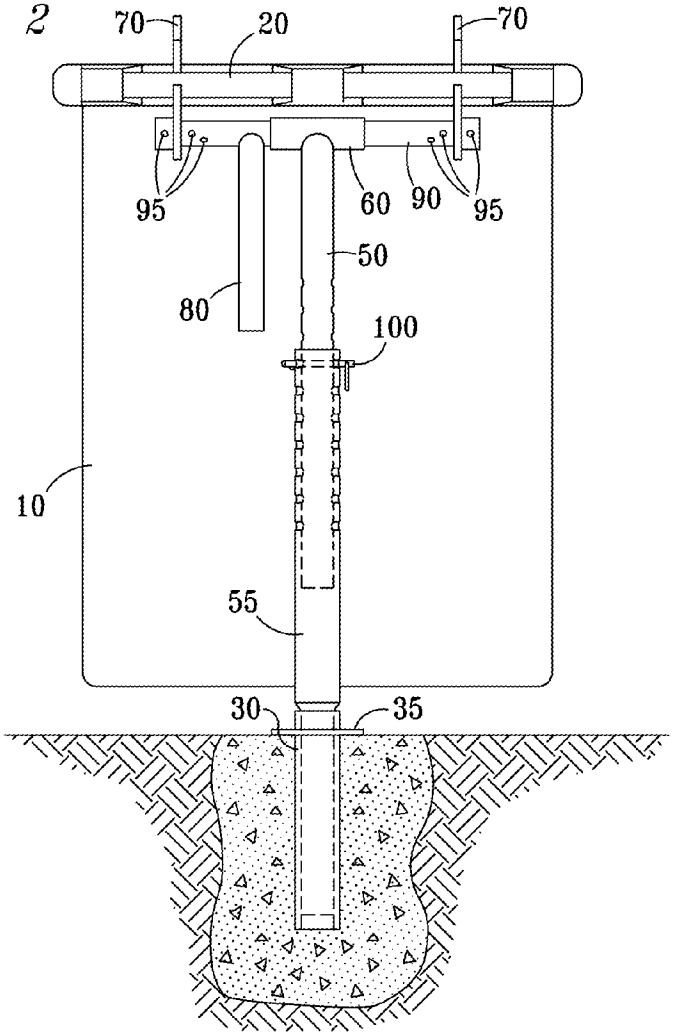
FIG. 2 is a rear perspective of a trash container supported above ground by the preferred, in-ground embodiment of the disclosed container support system
Figure 1:
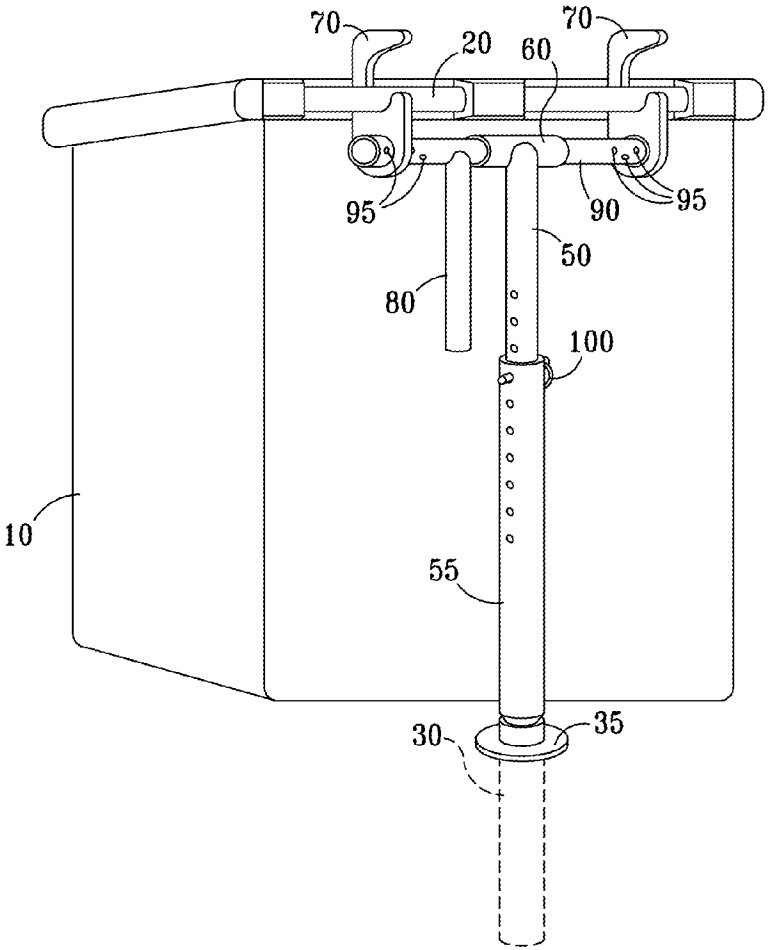
FIG. 1 shows a partial side perspective of a trash container supported above-ground and fully engaged in the preferred in-ground embodiment of the disclosed container support system

FIG. 1 shows a trash container 10 supported above ground (ground surface not shown) and engaged by the in-ground preferred embodiment of the disclosed container support system. The drawing shows a bar 20 of the container 10 engaged by and resting in grooves of two connecting claws 70 which are pivotally coupled to a lever 90 comprising a handle 80, the lever having a plurality of holes 95 enabling attachment of the connecting claws 70 at various points along the length of the lever 90, the lever 90 is coupled to a support section comprising an in-ground portion 30 and a height adjustable portion, the height adjustable portion comprising section 50 and section 55 fashioned with holes spaced along the length of each section which allow for height adjustable coupling of the sections with the help of a connecting pin 100. FIG. 1 depicts the handle 80 in a locked downward orientation and parallel to the side of the container. In that position, the container is suspended above a ground surface. FIG. 2 shows a front perspective of the container 10 per FIG. 1 which is supported above ground and engaged in the disclosed container support system.

FIG. 2 shows a rear perspective of the trash container of FIG. 1 supported above ground per the non-portable embodiment of the container support system.

Figure 3:
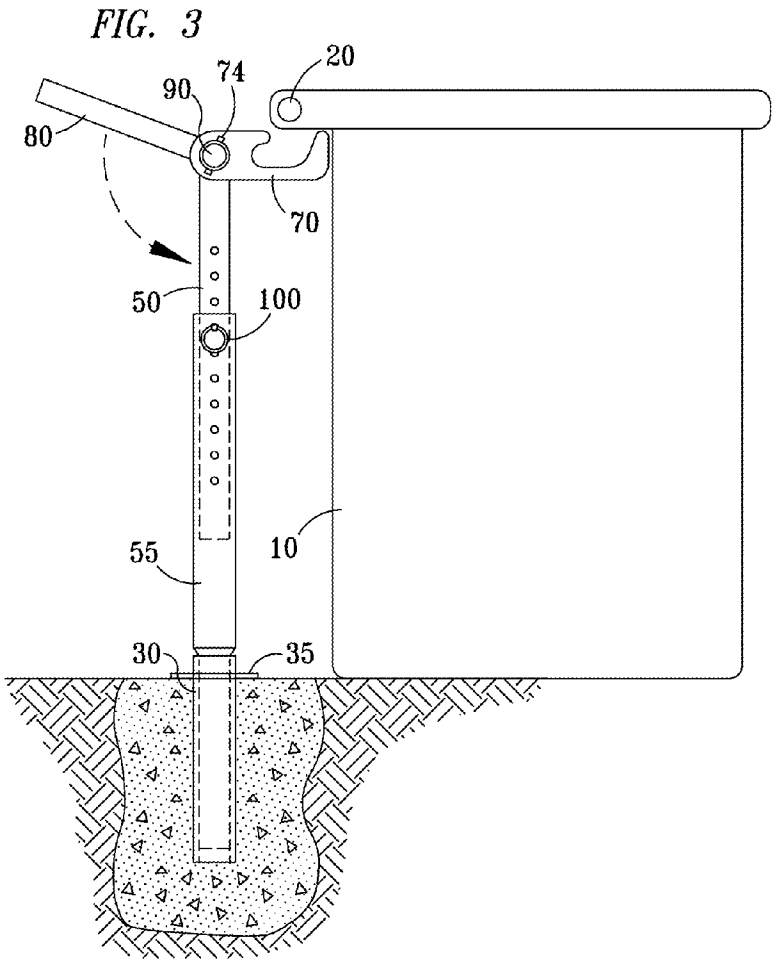
FIG. 3 shows a side perspective of a trash container about to be engaged in the disclosed container support system

FIG. 3 shows the position of the container relative the in-ground container support system just before engagement in the disclosed device.

Figure 4:
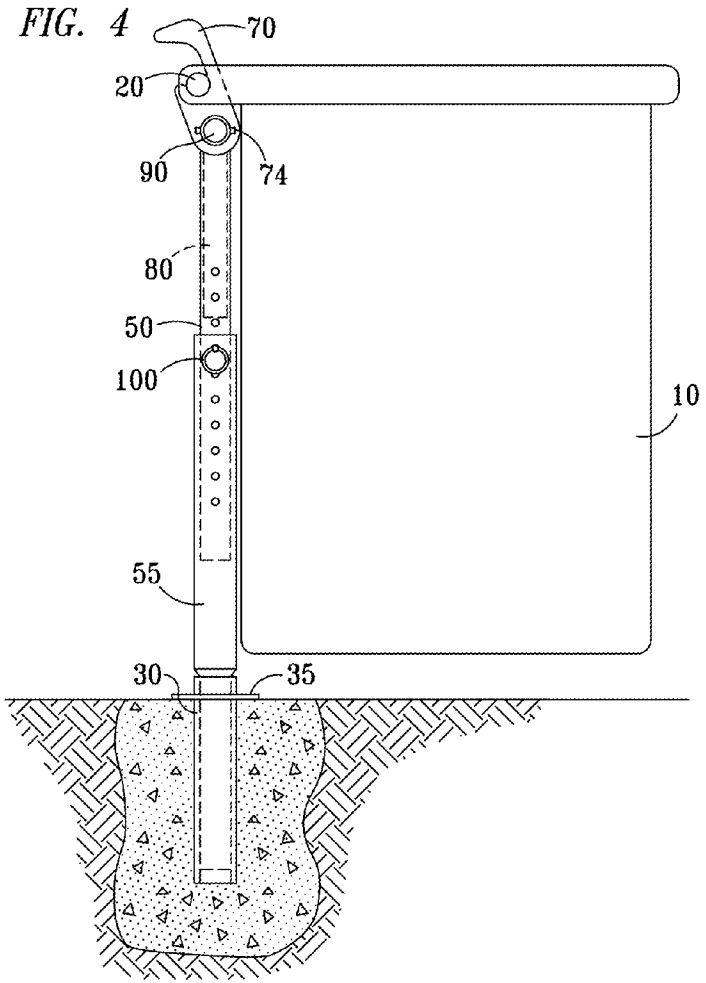
FIG. 4 is a side perspective of a container engaged in the in-ground preferred embodiment of the disclosed container support system

FIG. 4 shows the container engaged in the device and shows the locked position of the handle of the lever parallel to the wall of the container. When the container 10 is engaged in the disclosed device and in the locked position, FIG. 4 shows how the vertical centerline of the bar of the container 20 resting in the groove of each claw 70 is slightly forward offset relative to the vertical centerline of the pivot point of the claw 70 at the lever 90.

Figure 5:
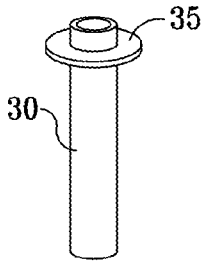
FIG. 5 is a view of the in-ground support portion with ground surface collar of the preferred embodiment of the disclosed container support system

FIG. 5 shows the in-ground element of the first support which sits at least partially underground and is leveled with the aid of an optional collar at ground level.

Figure 6:
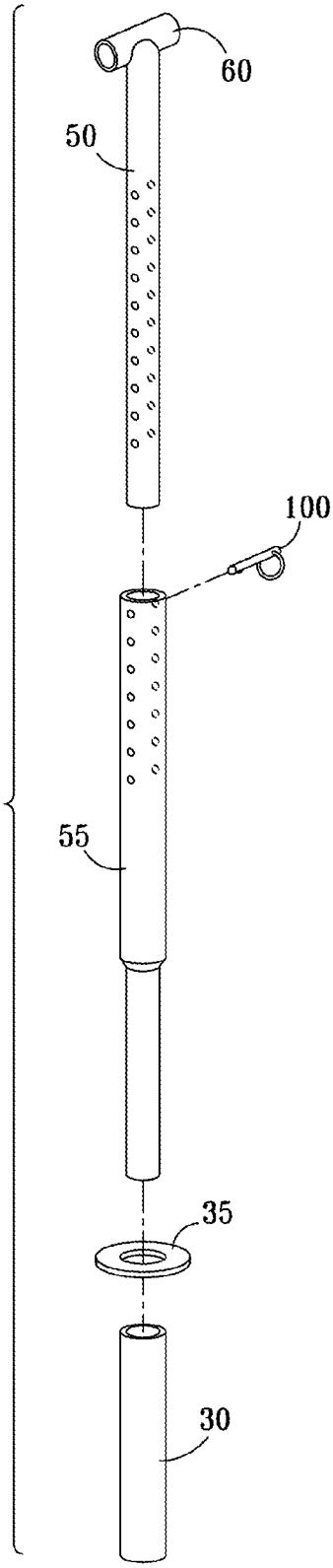
FIG. 6 is an exploded view of the elements of the vertical support section per the preferred embodiment of the disclosed container support system

FIG. 6 is an exploded view of the first support per the preferred embodiment and which has the height adjustability feature. Shown are the in-ground element 30, the optional leveling collar 35, a second support element 55 which is coupled to the in-ground element 30 and fashioned with a plurality of holes, a third support element 50 which is also fashioned with a plurality of holes and which is connectible to the second support element 55 and also has a collar 60 which is used to receive the arm lever (not shown).

Figure 7:
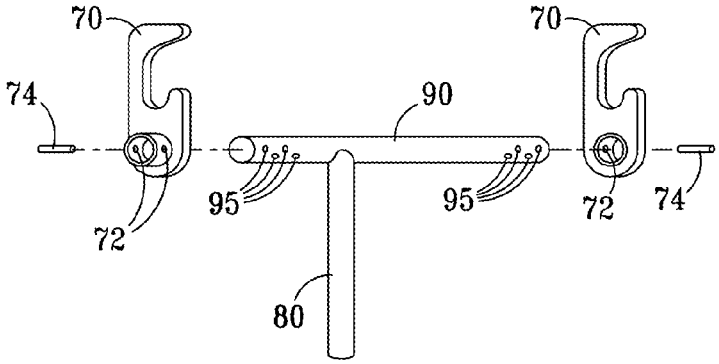
FIG. 7 is an exploded view of the so-called working portion of the disclosed container support system

FIG. 7 shows the manner of attachment of the connecting claw 70 with the lever 90 of the lifting mechanism per the preferred embodiment. The connecting claw 70 has internal holes 72 which are aligned with holes 95 of the lever 90 when the connecting claw 70 is slipped over the lever 90 and the connecting claw is then locked in place with the aid of a pin 74 at a desired position along the length of the lever 90.

Figure 8:
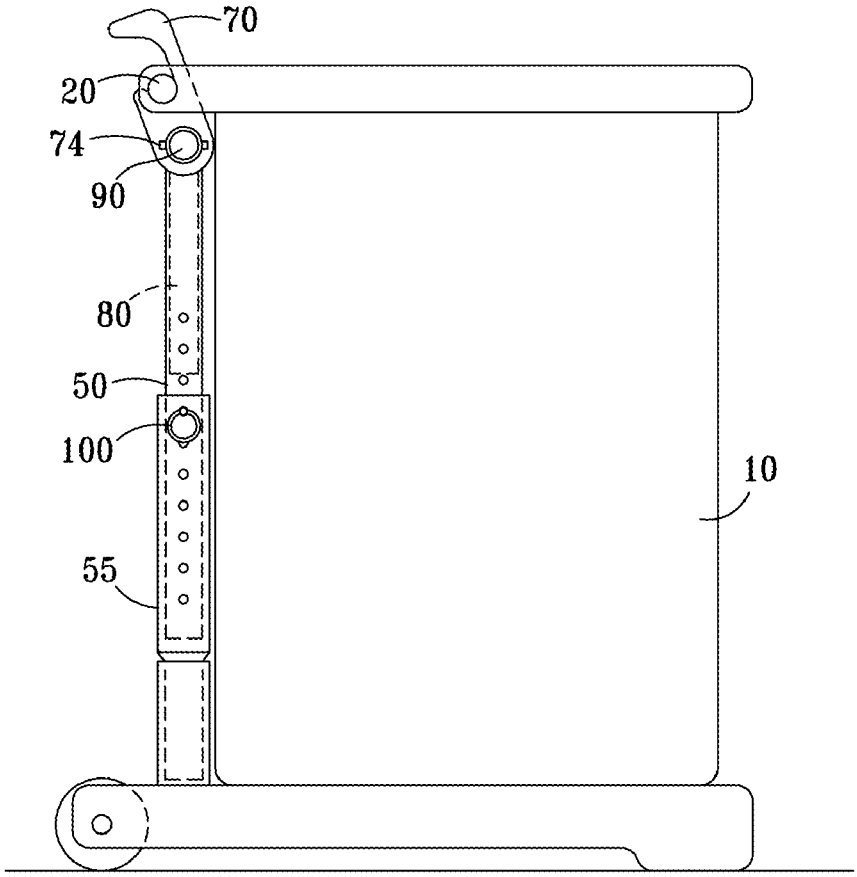
FIG. 8 shows a side profile of the portable embodiment of the disclosed container support system

FIG. 8 shows a side view of a container 10 engaged in a portable embodiment of the disclosed support system where the weighted base has rollers attached so that when the support system is tilted, the system with the engaged container may be moved around. When the container 10 is engaged in the disclosed device and in the locked position, FIG. 8 shows how the vertical centerline of the bar of the container 20 resting in the groove of each claw 70 is slightly forward offset relative to the vertical centerline of the pivot point of the claw 70 at the lever 90.

Figure 9:
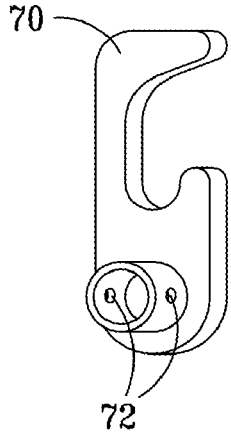
FIG. 9 depicts a connecting claw per the disclosed container support system

FIG. 9 is a close-up, partial view of a connecting claw 70 attached to the lever 90.

I claim:

1. An anti anti-tipping container support system for supporting a container above a ground surface, the container comprising a substantially horizontal bar running across an outer wall of the container, comprising a support portion fixedly attached to the ground surface in a substantially perpendicular relationship to the ground surface, a lifting portion comprising a lever rotatably coupled to the support portion in substantially a T-orientation relative to the support portion, the lever comprising a handle and at least two connecting claws pivotally attached to the lever on opposite sides of the handle and in a substantially perpendicular relationship to the lever, each connecting claw comprising a groove, such that when a manual downward force is applied to the handle with the bar of the container engaged in the grooves of the connecting claws, the lever rotates to lift and support the container off the horizontal surface via the connecting claws engaging the bar of the container.

2. The container support system per claim 1 wherein the support further comprises a height adjustability means for enabling support of the container at varying heights above the ground surface.

3. The container support system per claim 1 wherein the lever further comprises a plurality of spaced holes for attachment of the connecting claws at various points on the lever via a pin and retaining clip.

4. The container support system per claim 1 wherein the container is a trash container.

5. An anti anti-tipping container support system for supporting a container above a ground surface, the container comprising a substantially horizontal bar running across an outer wall of the container, comprising a first support portion attached to the ground surface in a substantially perpendicular relationship to the ground surface, a second support portion attached to the first support in a substantially collinear relationship to the first support portion, the second support portion comprising a first member and a second member, the first member for attachment to the first support portion, the first member and the second member each having a plurality of spaced holes, the first member and second member adjustably coupled with a pin and a retaining clip, the second member comprising a cylindrical, hollow collar portion on an end in substantially a T-orientation relative to the second member and the second support portion, a lifting portion comprising a lever rotatably coupled to the inside of the collar portion of the second member of the second support portion, the lever comprising a handle and at least two connecting claws pivotally attached to the lever on opposite sides of the handle and in a substantially perpendicular relationship to the lever, each connecting claw comprising a groove, such that when a manual downward force is applied to the handle with the bar engaged in the grooves of the connecting claws, the lever rotates to lift and support the container off the horizontal surface via the connecting claws engaging the bar of the container.

6. The container support system per claim 5 wherein the container is a trash container.

* * * * *